US005236329A

United States Patent [19]

Sylvester

[11] Patent Number: 5,236,329

[45] Date of Patent: Aug. 17, 1993

[54] BAND DELIVERY METHOD AND APPARATUS

[75] Inventor: Willem F. Sylvester, Maartensdijk, Netherlands

[73] Assignee: B. V. Metaverpa, Soest, Netherlands

[21] Appl. No.: 872,808

[22] Filed: Apr. 24, 1992

[30] Foreign Application Priority Data

Apr. 30, 1991 [CH] Switzerland ..... 01 294/91

[51] Int. Cl.[5] ..... B65B 13/02

[52] U.S. Cl. ..... 53/399; 53/589; 100/26; 100/32

[58] Field of Search ..... 53/137.2, 176, 389.4, 53/399, 419, 582, 589; 100/26, 32, 33 PB; 226/109, 110, 118

[56] References Cited

U.S. PATENT DOCUMENTS

| | | | |
|---|---|---|---|
| 3,137,426 | 6/1964 | Brenneisen | 100/26 X |
| 3,331,312 | 7/1967 | Leslie et al. | 53/589 X |
| 3,946,921 | 3/1967 | Noguchi | 100/26 X |
| 4,177,724 | 12/1979 | Johnson, III et al. | 100/32 X |
| 4,271,655 | 6/1981 | Nagayoshi | 53/589 X |
| 4,512,844 | 4/1985 | Kobiella | 53/582 X |
| 4,559,767 | 12/1985 | Takami | 100/32 X |
| 4,691,498 | 9/1987 | Stamm | 53/589 X |
| 4,845,928 | 7/1989 | Sakaki et al. | 53/589 |
| 4,938,009 | 7/1990 | Takami | 53/589 |
| 5,078,057 | 1/1992 | Pearson | 100/33 PB X |

FOREIGN PATENT DOCUMENTS

| | | | |
|---|---|---|---|
| 125195 | 11/1978 | Japan | 100/26 |
| 213109 | 8/1989 | Japan | 100/2 |
| 254508 | 10/1989 | Japan | 100/26 |

*Primary Examiner*—John Sipos
*Assistant Examiner*—Daniel Moon
*Attorney, Agent, or Firm*—Armstrong, Westerman, Hattori, McLeland & Naughton

[57] ABSTRACT

The band delivery apparatus has two separate band stores, namely a band forward store (10.1) and a band return store (10.2). The two stores are constructed as chambers, which is controllable manner can receive a predetermined band material quantity. The filling and emptying of the stores is brought about by a coordinated cooperation of a buffer store separator (3) and the conveyor rollers (17.1, 17.2). The buffer separator (3) blocks the band passage upstream of the supply/exit openings of the two band stores (20.1, 20.2) and consequently leads to a bulging of the band in the storage areas. The filling of at least the band forward store is preferably assisted by a delivery means (11). The necessary band material quantity during prestorage can be precisely determined by means of sensors.

18 Claims, 8 Drawing Sheets

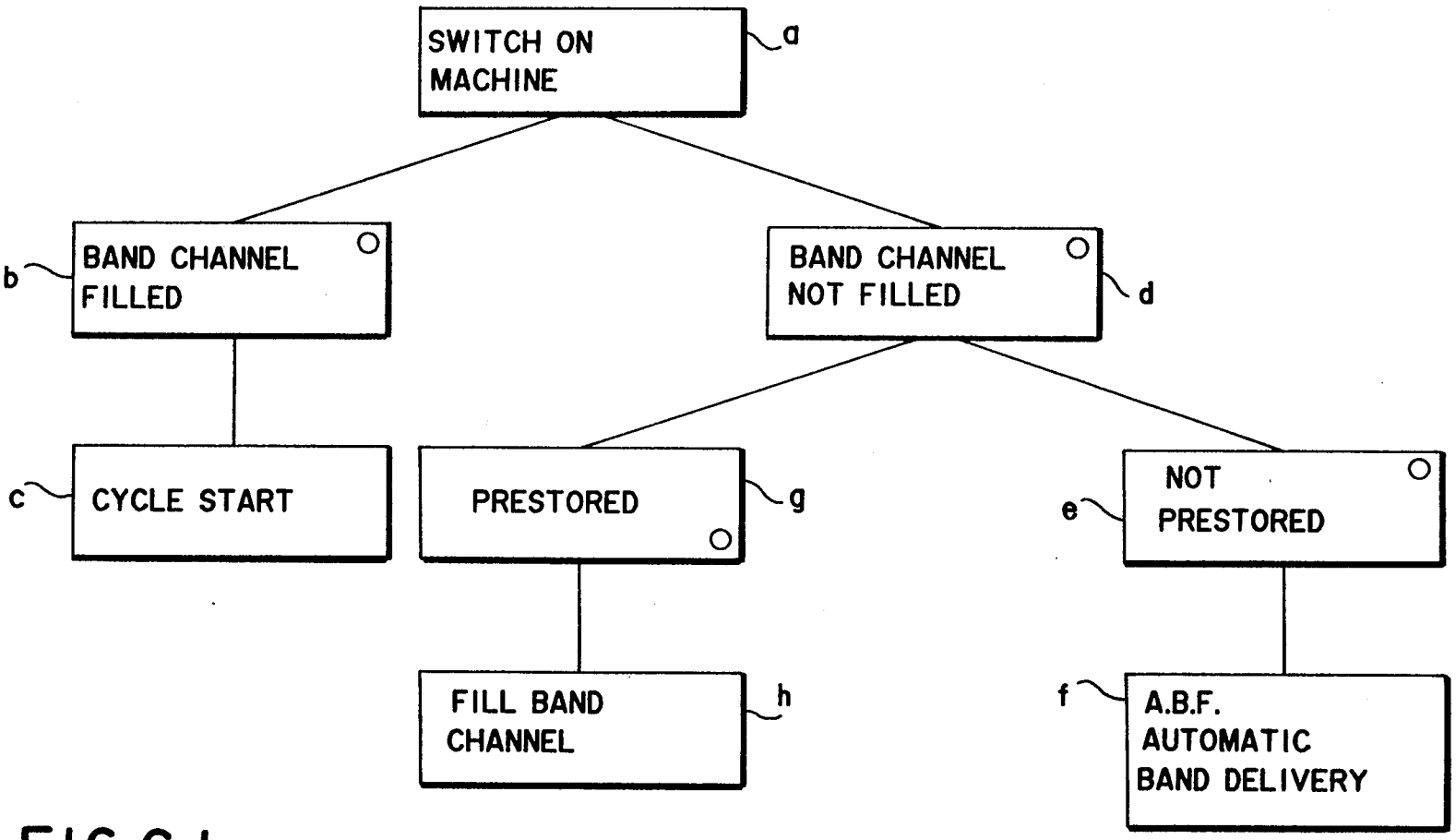
FIG.6.1

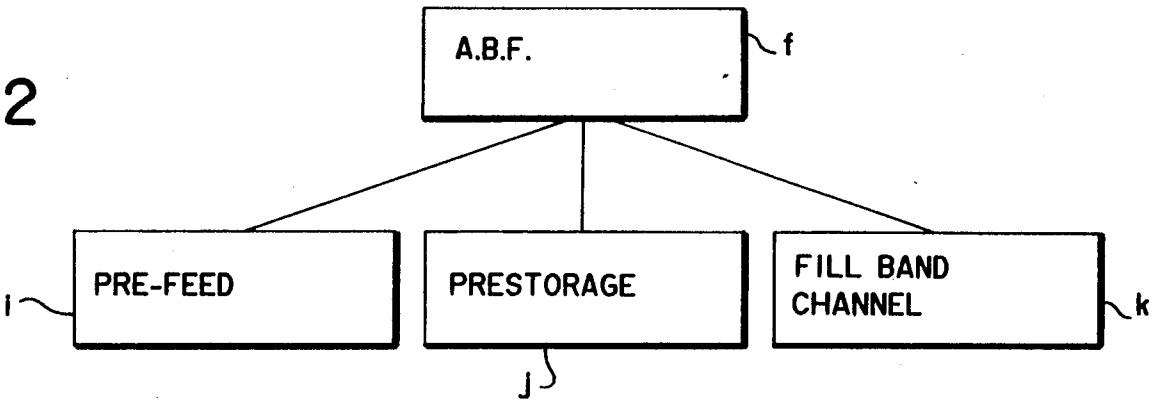
FIG.6.2
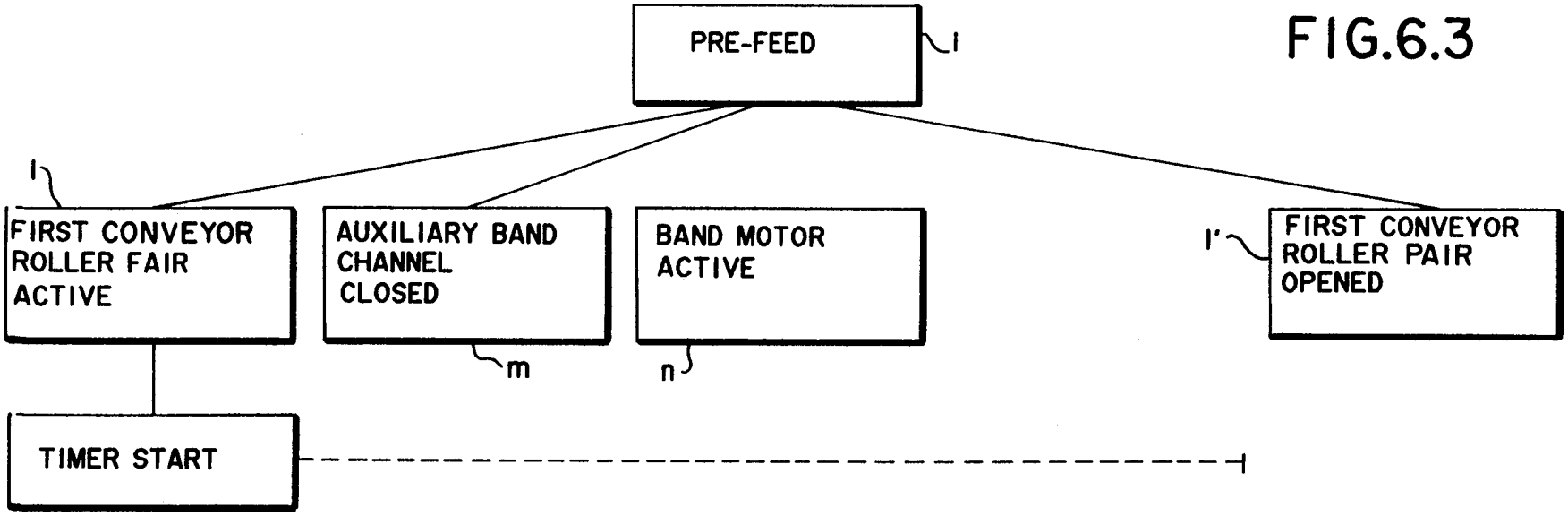
FIG.6.3

FIG.6.4
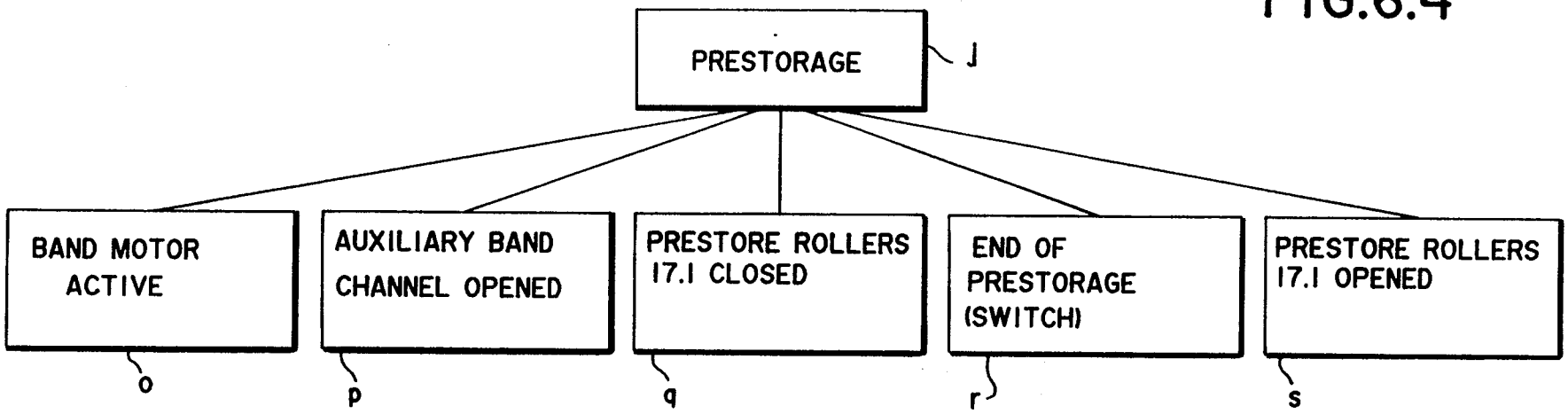

BAND DELIVERY METHOD AND APPARATUS

BACKGROUND OF THE INVENTION

The invention is in the field of packaging machines and relates to a band delivery method and apparatus having a band forward store and a band return store.

Metal or plastic bands, tapes, ribbons, strips and belts are frequently used as the encircling material for wrapping or encircling products or goods. The product to be packaged, e.g. a cardboard box or a bundle of magazines, newspapers, etc., is brought into the packaging position, is encircled by the band and is subsequently e.g. conveyed away for dispatch or shipping. Frequently the product is also covered crosswise by a band.

Numerous different apparatuses are known, which are used for the wrapping or encircling of products by means of bands. The externally visible operation of such encircling machines is often similar. The band is located in a band channel, which surrounds the product to be encircled. The band is stretched and jumps out of its position in the band channel and winds directly round the product being packaged. As a result of further stretching the product is closely wrapped and the band can then be connected (e.g. by bonding or welding), so that the encircling process is ended. If necessary, the product to be encircled or wrapped is turned and a second band loop is passed round it. For the next encircling process the band must be repositioned. When using such encircling machines in industrial production processes, the individual encircling processes are of a periodic nature and are generally repeated according to a system cycle.

In modern plants extremely high processing capacities are required, so that high demands are made on such encircling machines and band material as regards reliability, dynamics and operator friendliness. A considerable disadvantage of known machines of this type relates to the supply of the band. Known band delivery systems are extremely complex and therefore susceptible to faults. In order to be able to achieve high process speeds during encircling, frequently use is made of mechanically complicated band prestores, which require a manual threading and insertion of the band, besides the disadvantage of their slowness and fault susceptibility when changing empty band rolls. This manual changing of the bands leads to long process interruptions or requires a redundant system of encircling machines. Due to the complicated construction of such band delivery systems and due to the necessary redundancy, known systems are also relatively expensive. Conventional band delivery constructions do not provide adequate protection to the band, which leads to damage (bending, tearing, etc.) or weakens the band. Frequently the storage constructions used are very poor in this connection in that they bring about a completely uncontrolled storage of the band material. Another disadvantage of known constructions is that the individual band delivery systems are adapted to specific bands. Thus, it is generally not possible to change between different bands and it is necessary to accept disadvantages (reduced packing quality, lower speed, etc.), or alternatively the machine has to be reequipped.

SUMMARY OF THE INVENTION

The problem of the invention is consequently to provide a band delivery and storage system, which avoids the disadvantages of known band delivery means and which ensures a reliable, rapid, careful and simple band delivery, which ensures a rapid replacement of empty band reels and enables band delivery to be automated in a simple manner.

This problem is solved by having a band forward store and a band return store providing a band delivery apparatus having feed means for forwardly and reversely feeding a band along a band path toward and from an application location, a band forward store having a first chamber and a first chamber opening, a band return store having a second chamber and a second chamber opening, the first chamber opening and the second chamber opening each being located in a transverse direction off of the band path, locking means for selectively locking the band at a location along the band path in between said first and second chamber openings and for selectively allowing the band to pass along the band path, and the locking means enabling a central portion of the band to buckle in a direction transverse to the length of the band into the first chamber through the first chamber opening for prestorage of the band during forward feeding of the feed means and enabling a central portion of the band to buckle in a direction transverse to the length of the band into the second chamber through the second chamber opening for return storage of the band during reverse feeding of the feed means.

BRIEF DESCRIPTION OF THE DRAWINGS

The invention is described in greater detail hereinafter relative to a non-limitative embodiment and with reference to the attached drawings, wherein show:

FIGS. 6.1–6.4 Diagrammatically the sequence and principle of the inventive method.

DETAILED DESCRIPTION

Figure 1:
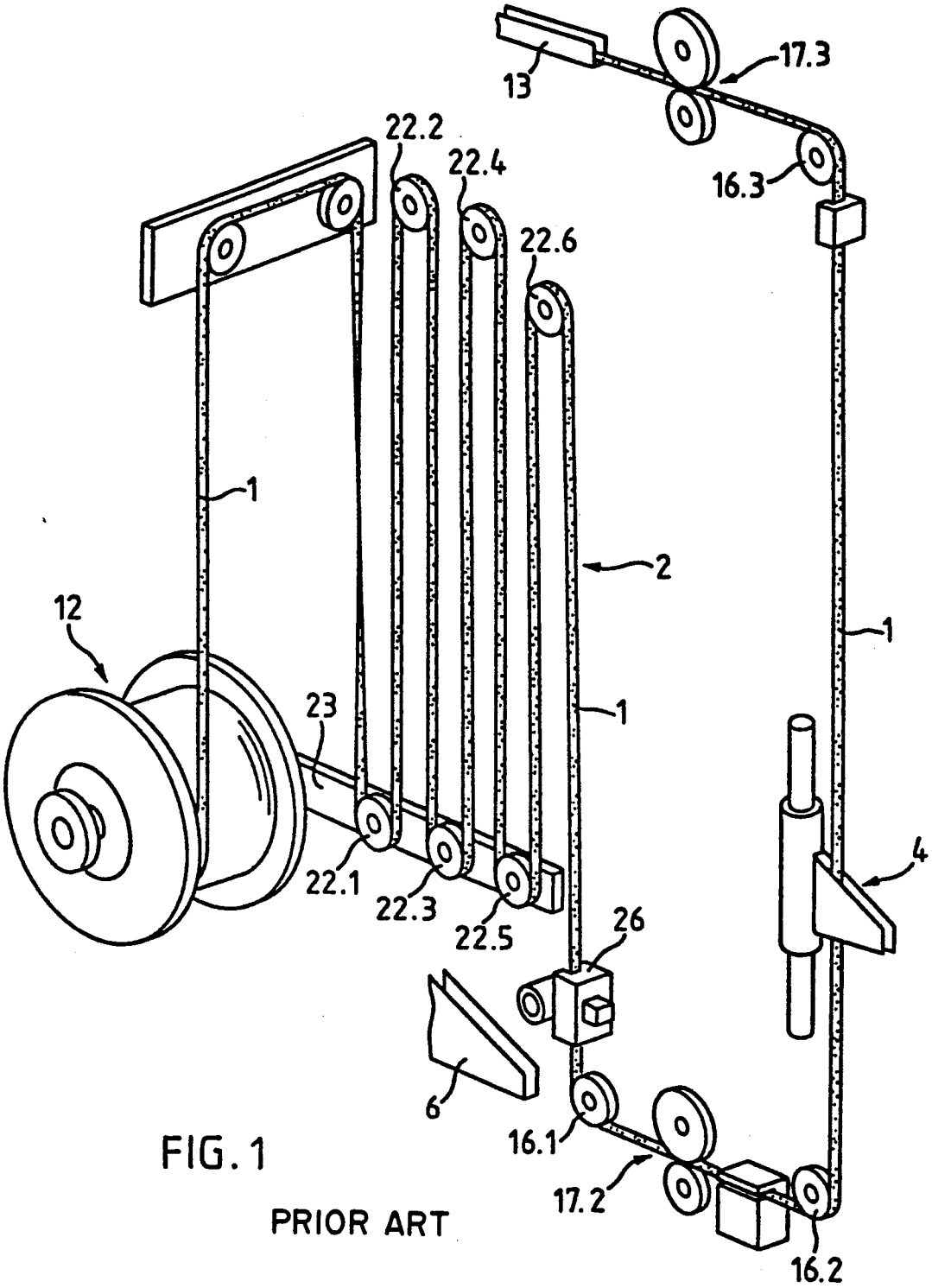
FIG. 1 PRIOR ART
FIG. 1 The basic construction of a conventional band delivery means.

FIG. 1 diagrammatically shows a conventional band delivery system. The band 1 is supplied from a band reel 12 by means of a band forward or advance store 2 and guided by means of several guide pulleys 16.1–16.3 to the packaging point or the band channel 13. By means of conveyor roller pairs 17.2, 17.3 the band can be conveyed forwards (in the direction of the band channel 13) and backwards on stretching the band (into the band return or reverse store 6). The insertion of the band 1 in the band channel 13 must take place at a high speed of e.g. $v=9$ m/s. As the direct supply of the band from the reel 12 would be too sluggish for the necessary band delivery speed, in order to achieve the necessary high speed, the aforementioned band advance store 2 is provided. In the represented construction the latter comprises a movable store arm 23 with guide pulleys 22.1, 22.3 and 22.5 and fixed suspended guide pulleys 22.2, 22.4, and 22.6 over which the band is guided in meander-like manner. If the band 1 is now conveyed forwards at high speed, then the store arm 23 together with the guide pulleys 22.1, 22.3, 22.5 approaches the fixed guide pulleys 22.2, 22.4, 22.6 and consequently the tape advance store 2 is partly emptied. This construction has a tape advance store undefined with respect to the band quantity, the manual band insertion process is very complicated and the system has relatively low dynamics. The low dynamics leads to jerky stressing of the band at high speeds, which can lead to very high tensile forces in the band.

If during the encircling process the band 1 is stretched by means of the conveyor rollers 17.2 and a stretching device 4 and consequently conveyed back, then the tape is taken up by the return store 6. On returning (stretching) the band, the short-term occurring material is collected in a buffer store. A band brake 26 is provided for maintaining the band tension, e.g. when the conveyor rollers 17.2 are raised.

Other tape delivery systems even use the same store for drawing in the tape and conveying back. It is clear that due to the identity of the store for delivery and stretching the individual sequences (supply of the tape from the tape reel 12 and return of the tape during stretching) must take place in a time-separated manner, in order to ensure an adequate operational reliability (avoidance of tape entangling) and in order not to overtax the dynamics of the store.

Another important problem of conventional band delivery systems is the generally uncontrollable storage of the band. Apart from devices which do not even have a definable store size, constructions are known which although having a specific store, unnecessarily store the band, so that the latter is deformed or destroyed. In particular, no account is taken of the fact that the same space can take up more or less of the band when using different band materials and/or the ambient temperature fluctuates (spring tension of the band material).

The inventive idea is based on increasing the dynamics of the supply/stretching process (and therefore the packaging speed) and to protect the band material by substantially avoiding mechanical parts and by separate, engageable band forward and return stores and in that said stores automatically self-load and self-empty without any manual action.

Figure 2:
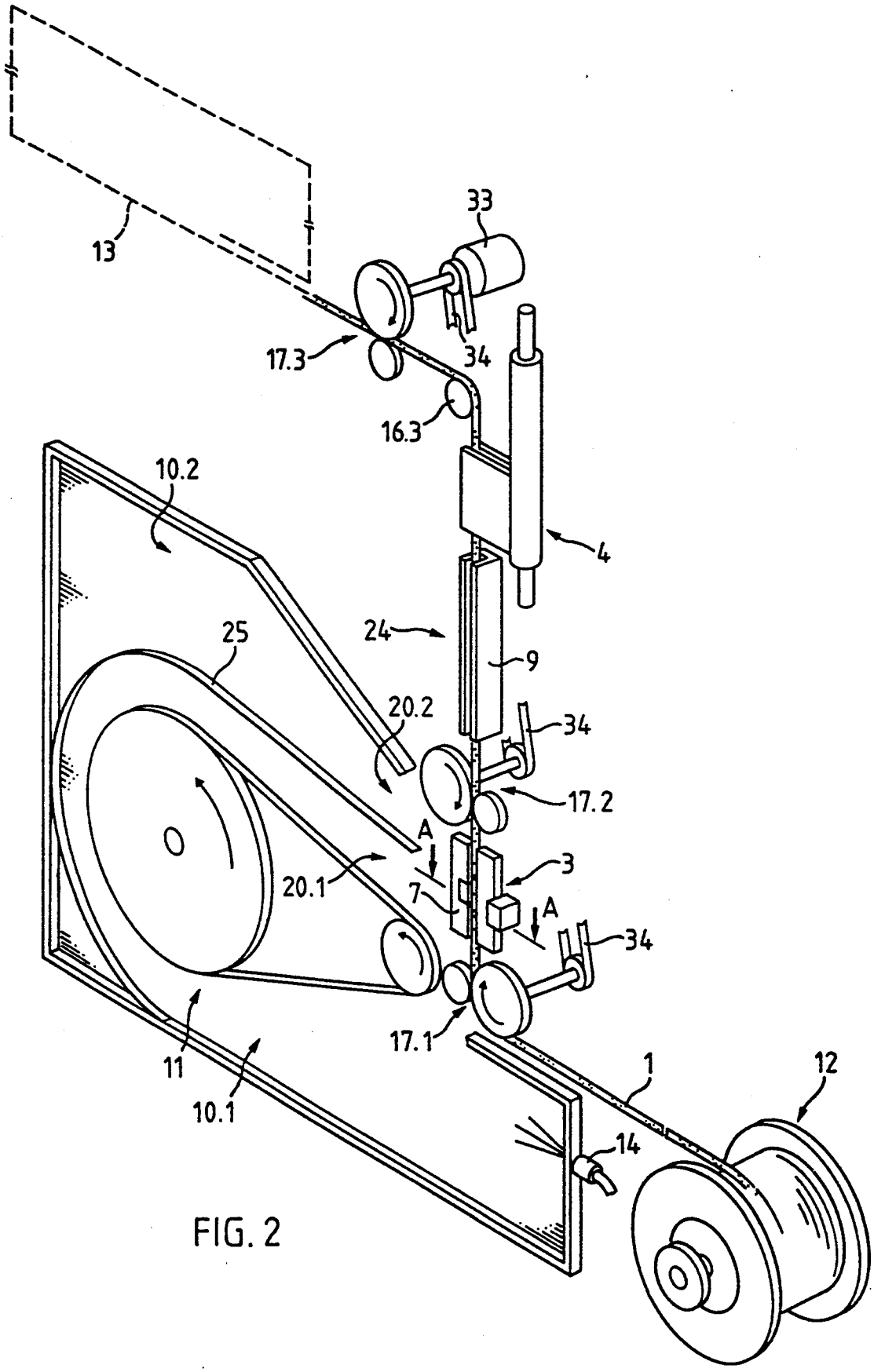
FIG. 2 The inventive band delivery system with empty stores.

FIG. 2 shows an embodiment of the inventive apparatus. The band 1 is supplied by a band reel 12 and is drawn in by means of a first conveyor roller pair 17.1, which simultaneously deflects the band. It then passes through a buffer store separator 3, which is used for selecting the desired store or buffer store. Said separator 3 is followed by a second conveyor roller pair 17.2, which is used for returning the band during the encircling of the product to be packaged. The band is guided linearly over a long distance and in this area, i.e. the stretching section 24, is guided at least partly by a band supply channel 9. On inserting a new band from the band reel or if no band has been introduced up to the band channel 13, said band supply channel permits an automatic insertion of the band or an automatic loading of the channel 13 (pre-feed), in that it prevents any band bending.

The band is guided by means of a further guide pulley 16.3 level with the packaging point. Finally, a third conveyor roller pair 17.3 delivers the band in the area upstream of the band channel 13 (packaging point), which is here shown in broken line form and is therefore used for loading the band channel 13. The drive of the conveyor roller pairs 17.1–17.3 takes place by means of a common band motor 33 via drive belts 34, the rotation directions of the conveyor roller pairs being shown in the drawing. FIG. 2 also shows a tensioning or stretching device 4. If the stretching device 4 is moved linearly against the normal band delivery direction during the stretching of the band 1, then the band supply channel 9 can be swung away, so that said two devices do not interfere with one another.

According to the invention there are two band stores 10.1, 10.2, which are both still empty in the drawing. The band stores are designed as flat chambers, which in each case have a supply/discharge opening 20.1, 20.2. Apart from these two openings 20.1, 20.2 the chambers are substantially closed and have a width, which corresponds to the width of the widest tape material to be used, i.e. 4 to 20 mm, but preferably 5 mm. In the present embodiment the stores are formed from flat, closed plate sandwich constructions with plastic or metal plates, which for the subdivision of the two chambers has a partition 25 located between the plates. The size of the two chambers is adapted to the necessary length of the band material to be stored. This ensures that in the stores there can be no damage to the tape (bending, superfluous, narrow loops, etc.) and no entanglement. For the tape forward store 10.1 is provided a monitoring sensor 14, e.g. a light barrier or a distance measuring sensor enabling the monitoring and control of the quantity of band material to be stored. For monitoring the band return store 10.2 a corresponding sensor can be provided, which allows an even more precise monitoring of the band storage. A movable auxiliary band channel 7 is used for guiding the band 1 (pre-feed), in that it bridges or frees the openings 20.1, 20.2 of the two stores 10.1, 10.2. The operation of this band delivery system will now be explained relative to the following drawings.

Figure 3:
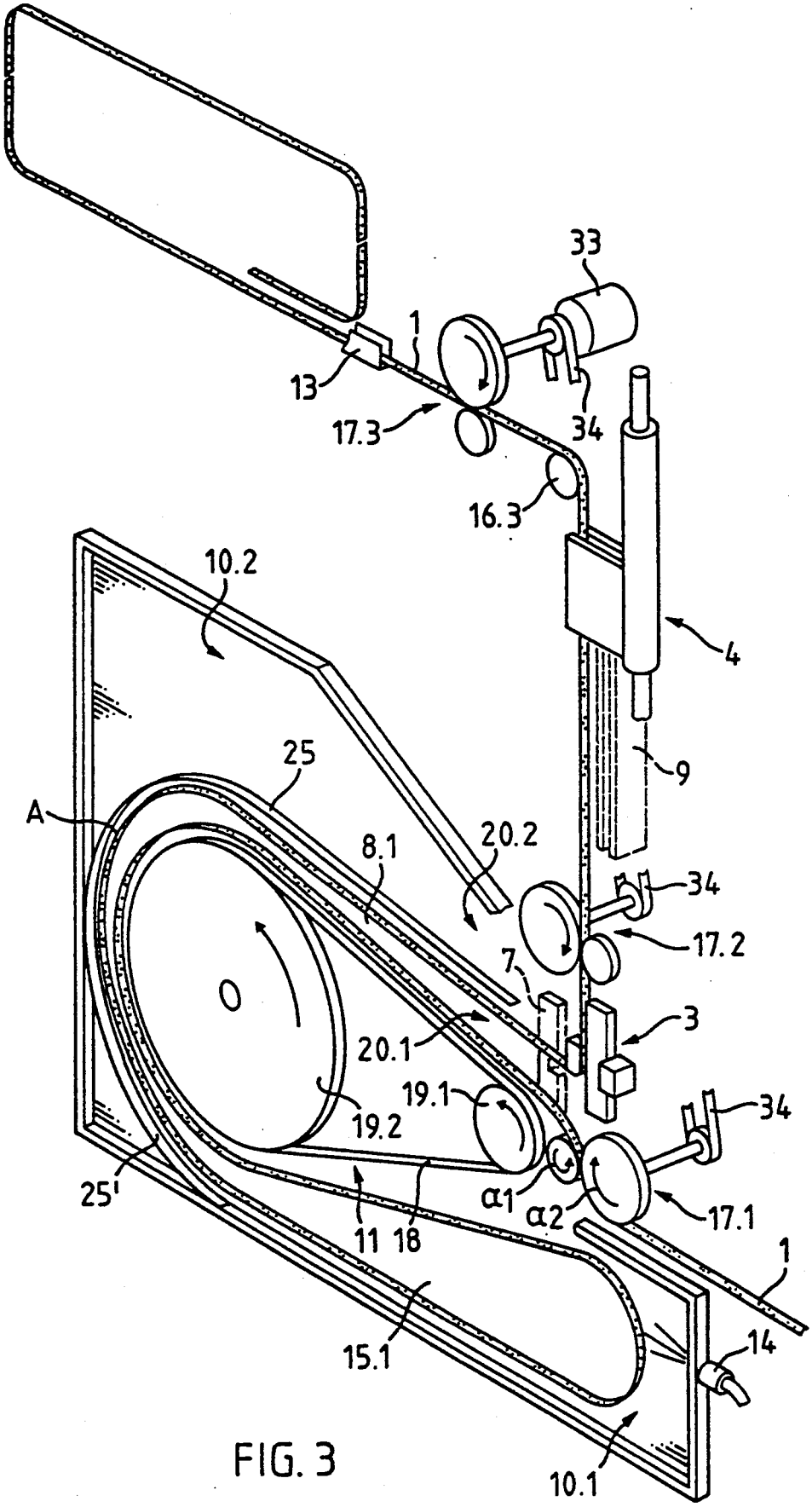
FIG. 3 The inventive band delivery system with a filled prestore.

FIG. 3 illustrates the filling of the band forward store 10.1, i.e. the so-called prestorage. As can be gathered, the band has already been introduced into the not shown band channel 13, i.e. the plant is ready for the packaging of a unit to be encircled. During the waiting phase or also during packing (i.e. during the stretching of the band) it is possible to fill the band forward store 10.1. The filling process of the latter is initiated by drawing in band material by means of the first conveyor roller pair 17.1 and prior or simultaneous operation of the buffer store separator 3, whose operation will be subsequently explained relative to FIG. 5. The auxiliary band channel 7 is in the laterally swung away state. By blocking the band passage in the area of the supply/discharge opening 20.1, the buffer store separator 3 permits the free band passage at this point. If simultaneously with the blockage the first conveyor roller pair 17.1 is driven forwards, as indicated by the arrows $\alpha_1$ and $\alpha_2$, then the band is bulged out in loop-like manner in the area upstream of the buffer separator 3. This band bulging A is taken up by the band forward store 10.1, which is here constructed as a flat chamber. The drawing of the band bulge or loop into the storage area is aided by a delivery arrangement 11, here in the form of two rotary discs 19.1, 19.2 with a revolving conveyor belt 18. Thus, the band material can be particularly carefully drawn into the storage space. The delivery arrangement 11 is driven by the band motor 33 (FIG. 2) or a separate drive. During the filling of the band forward store 10.1 the rotation direction of these rotary discs 19.1, 19.2 is chosen in such a way that the band bulge A is drawn into the introduction channel 8.1 of the store 10.1 and passed into the actual storage space 15.1. The monitoring sensor 14 emits a signal, which can in particular be used for switching on and off the delivery of the first conveyor roller pair 17.1. As soon as the storage area 15.1 is filled, the filling of the store is interrupted in such a way that there can be no band deformation or entanglement as a result of too much band material in the band forward store 10.1. It is simultaneously ensured that the band only undergoes one bend, i.e. it is fully controllable and does not collapse, i.e. bend in. The filling of the band store is then brought about by coordinated cooperation of the buffer store separator 3 with the conveyor roller pair 17.1. At the end of prestorage the rollers of the first conveyor roller pair 17.1 are raised and the drive thereof interrupted, i.e. it is possible for the band 1 to pass freely between the rollers. In the same way as in conventional systems, it is possible to provide a not shown band brake for maintaining the band tension. On emptying the band store the upper band rises in friction-free manner on the lower band.

The structure of the band forward store is important for a completely satisfactory operational reliability. It is firstly a requirement that a variable and in certain circumstances large quantity of different tape or band material can be stored in controlled manner without impairing the band, whilst it is also desired that the store has minimum dimensions. As can be gathered from FIGS. 2 and 3, the band forward store is shaped like a closed channel with varying height, i.e. at the supply/-discharge opening 20.1 of the said store said channel is relatively narrow and widens towards the actual storage area 15.1. The narrow sides of the channel are formed on the one hand by a partition 25 between the band forward and return stores or an end wall 25', into which the partition passes and on the other hand by a correspondingly arranged conveyor belt 18. The channel has a U-shaped bend, which leads into the storage space 15.1, where the channel widens. In the present case the radius of curvature of said bend is predetermined by the rotary disc 19.2. The radius of curvature of the channel is adapted to the band materials used and the field of use of the machine. For special applications said channel or the storage area can be lengthened or expanded and e.g. have a second bend or curve. The inventive band forward store 10.1 leads to the band not being impeded by mechanical parts, such as guide pulleys, etc. and consequently it is possible to avoid harmful stressing of the band (elongation, jerky loading, etc.).

Figure 4:
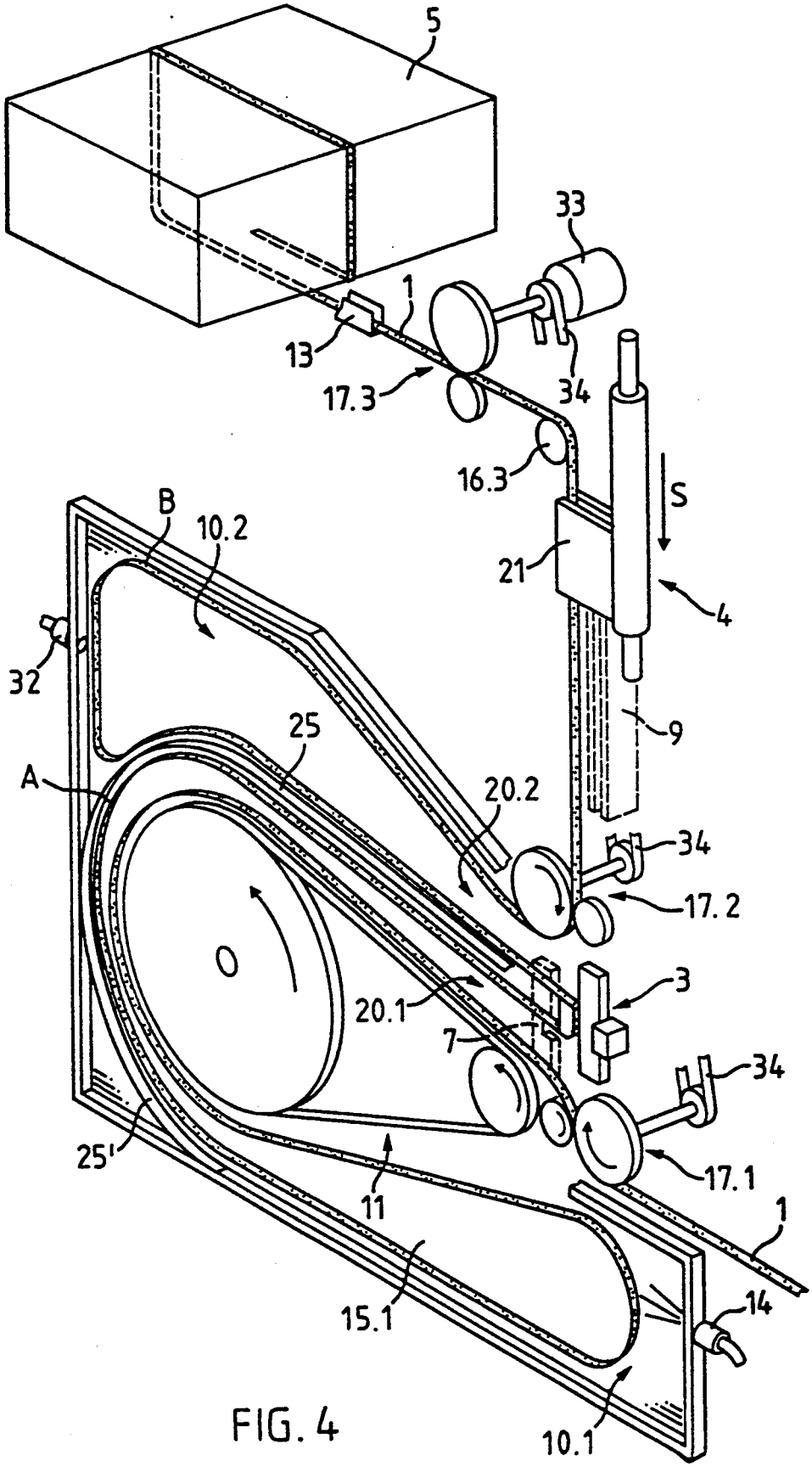
FIG. 4 The band delivery system with filled stores.

FIG. 4 shows the apparatus with the filled band forward store 10.1 and the filled band return store 10.2 immediately following packing, i.e. after stretching the band 1. The band return store 10.2 is filled in a similar manner to that used for filling the band forward store 10.1. The blocking of the buffer store separator 3, accompanied by the simultaneous return of the band 1 by means of the second conveyor roller pair 17.2 brings about a band bulge B, which is received by the opening 20.2 and then by the band return store 10.2. As can be gathered from the drawing, the band return store has no device corresponding to the delivery arrangement 11, because the store 10.2 need generally only receive a relatively small amount of band material and consequently no additional auxiliary device is required for drawing in the band. The maximum band material quantity to be received by the band store 10.2 is dependent on the length of the band channel 13 or the product to be encircled or wrapped. The return of the band 1 by means of the second conveyor roller pair 17.2 takes place before or during the stretching of the band 1 with the stretching device 4. The broken lines indicate that the band supply channel 9 is pivoted or moved away from the band 1, in order to give space for the stretching device 4. The necessary movement preferably takes place by means of a not shown lift cylinder. The stretching device 4 is provided with a gripper 21, which secures the band 1 and draws it by means of a linear stretching movement in the direction of the arrow S out of the band channel 13 (cf. FIGS. 1 and 2, not shown in detail here), so that it then passes round the unit 5, as indicated in the drawing. A rocking lever control is provided by means of the guide pulley 16.3. This makes it possible to accurately control if the band is tensioned round the product to be encircled with the predetermined tensile force, so that the stretching process is interrupted or the delivery drive (motor and cylinder) can be immediately switched off and the band is not destroyed. The inventive apparatus has the additional advantage that the stretching device 4 and the return rollers (conveyor roller pair 17.2) are positioned in such a way that the band is not tensioned over two or more additional guide pulleys, which could lead to undesired band deformations in the case of the high, briefly occurring tensile forces. The band can then be bonded or welded in a conventional manner and a new packaging cycle can commence.

Figure 5:
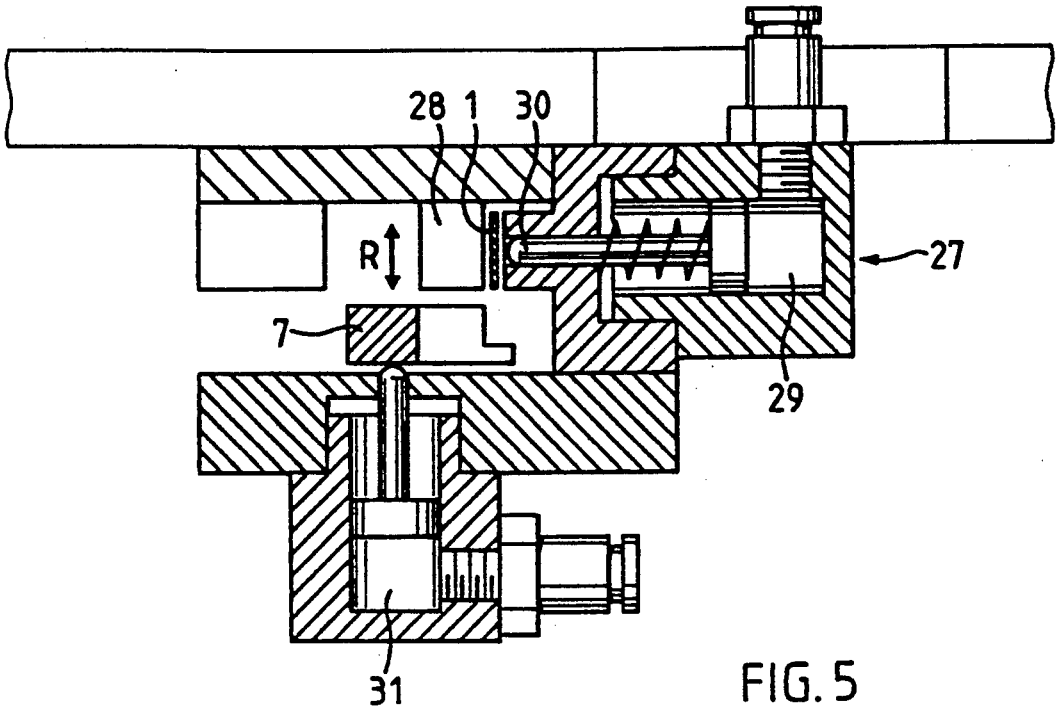
FIG. 5 A cross-section through the buffer store separator.

FIG. 5 illustrates the operation of the buffer store separator 3, showing a cross-section through said separator along line A—A (FIG. 2). The band 1 passes through a locking device 27, which comprises a locking pin 30 movable by means of a pneumatic cylinder 29, as well as a pressing element 28. If the lock is activated, the band is fixed between the locking pin 30 and the pressing element 28 and consequently the band passage through the buffer separator is inhibited or interrupted.

A second hydraulic or pneumatic cylinder 31 is used for adjusting the auxiliary band channel 7 (cf. FIG. 2 and 3). By operating this hydraulic cylinder the auxiliary band channel 7 can be moved backwards and forwards in the direction of the arrow R. FIG. 5 shows the auxiliary band channel 7 in the swung away position, i.e. the supply/delivery openings 20.1, 20.2 of the stores 10.1, 10.2 are freed or opened. During pre-feed the auxiliary band channel 7 is closed, whilst during prestorage of the band and its return and buffer storage it is laterally swung away.

The inventive method will now be explained in detail relative to FIGS. 6.1 to 6.4, reference being made to the individual method stages with letter references. The essence is constituted by the cyclic, coordinated control of the band forward and return store 10.1, 10.2. FIG. 6.1 is an overall diagram. On switching on the machine (a) firstly it is necessary to establish whether the band channel is full or empty. If the band channel 13 is full (FIGS. 1, 2) (b), it is possible to directly start with the cyclic packing or band delivery process (c). The filling of the band channel requires a prestorage of the band, because the latter must be inserted at a relatively high speed into said channel. Thus, in the case of an empty band channel (d) prestorage of the band is initially necessary. Thus, if the band forward store 10.1 (FIG. 2) is not yet filled (e), from the band reel 12 (FIG. 2) band must automatically be delivered (f). If the band forward store is already adequately filled with band material (g), then the filling of the band channel (h) can directly commence.

FIG. 6.2 shows in greater detail how automatic band delivery (f) takes place. If the band has not yet been introduced into the machine, a so-called pre-feed (i) must be initiated, i.e. the band must be drawn from the reel by means of the band motor. This process will be described in greater detail relative to FIG. 6.3. If the band has already been drawn in at least up to the third conveyor roller pair 17.3 (FIG. 2), then the band forward store 10.1 (FIG. 3) is filled (j). For this purpose firstly the auxiliary band channel 7 is opened (FIG. 2) and as a result the supply/discharge opening 20.1 is freed. By means of the first conveyor roller pair 17.1 the band is further drawn in and in the case of prior or simultaneous operation of the buffer store separator 3 the band is introduced in the described manner into the band forward store 10.1. The monitoring sensor 14 (FIG. 2) indicates the full store state or that predetermined by means of a control unit. The band channel 13 (FIG. 2) can now be filled (k), the prestored tape in the band forward store 10.1 being used. It must be ensured that when filling the band channel any band material present in the band return store 10.2 is firstly emptied and only then is use made of the band material in the band forward store. As the invention seeks a controlled storage of band material, when using difficult materials it can be advantageous to monitor the filling state by means of a sensor also in the case of the band return store. Such a monitoring sensor 32 for said store 10.2 is shown in FIG. 4 and makes it possible to match the band quantity during prestorage to the band quantity already in the band return store 10.2 and avoid a superfluous band material storage. Simultaneously with or immediately after the filling of the band channel, a further prestorage is possible.

The pre-feed process (i) is illustrated in FIG. 6.3. On changing a band reel 12 (FIG. 2) or in the case of a tearing of the band, the band must be reinserted into the machine or the band delivery system, the band start being manually or automatically drawn up to the first conveyor roller pair 17.1 (FIG. 2) by means of a not shown additional device. It must in particular be stressed that any manual introduction only takes place up to a conveyor roller pair 17.1 positioned upstream of the band forward store 10.1 and unlike in conventional constructions there is no need to load the store. As a result of the inventive design of the band delivery means, it is possible for the remaining introduction, prestorage, etc. to take place completely automatically. The conveyor rollers 17.1 are active (1) during the pre-feed process and draw the band further in until it reaches the third conveyor roller pair 17.3. The auxiliary band channel 7 and the band supply channel 9 (FIG. 2) are closed (m) in order to guide the band past the two buffer stores 10.1 and 10.2 and into the vicinity of the stretching device. Obviously for the purpose of said band delivery, the band motor driving the corresponding conveyor rollers 17.1–17.3 must be active (n). Following the pre-feed process, the first conveyor roller pair 17.1 no longer delivers the band and it is in the raised state (l').

The prestorage process (j) is further illustrated by FIG. 6.4. The band motor is active (o) and drives the first conveyor roller pair 17.1 (FIG. 2), whose rollers are closed for gripping the band, i.e. are located in position (q). The auxiliary band channel 7 is open during prestorage (p). The end of prestorage is indicated by a signal of the monitoring sensor 14 (r). This signal serves as a control signal for the disconnection of band delivery by means of the first conveyor roller pair 17.1 and simultaneously the latter is opened (s). It must again be stressed that the prestorage of band material and the loading of the band channel are coordinated or matched to one another and according to the invention preferably take place in a cyclic, regular sequence. Thus, at all times there is a band material quantity in the band advance store 10.1 matched to the band channel length and the prestorage and loading of the band channel take place in time-matched intervals.

In the present embodiment the drive for the conveyor rollers is brought about by a common band motor 33, e.g. an electric motor. The drive direction is reversible, so that the band can be conveyed forwards and backwards. All the conveyor roller pairs 17.1–17.3 are driven by means of couplings or belts 34. Thus, the band motor 33 is active during the following processes:

pre-feed (drive of all conveyor roller pairs 17.1–17.3),
prestorage (drive of the first conveyor roller pair 17.1),
filling the band channel (drive of the third conveyor roller pair 17.3),
return (drive of the second conveyor roller pair 17.2).

In order to interrupt the drive of the individual roller pairs 17.1–17.3, said rollers can be raised, i.e. moved apart by means of small lift cylinders, so that the band is no longer engaged and conveyed. If certain processes are to take place simultaneously (e.g. filling of the prestore whilst simultaneously loading the band channel), then the necessary conveyor roller pairs are correspondingly connected in.

I claim:

1. A band delivery apparatus, comprising:

feed means for forwardly and reversely feeding a band along a band path toward and from an application location;

a band forward store having a first chamber and a first chamber opening;

a band return store having a second chamber and a second chamber opening;

said first chamber opening and said second chamber opening each being located in a transverse direction off of the band path;

locking means for selectively locking and stopping the band at a location along the band path in between said first and second chamber openings and for selectively allowing the band to pass along the band path; and said locking means enabling a central portion of the band to buckle in a direction transverse to the length of the band into said first chamber through said first chamber opening for prestorage of the band during forward feeding of said feed means and enabling a central portion of the band to buckle in a direction transverse to the length of the band into said second chamber through said second chamber opening for return storage of the band during reverse feeding of said feed means.

2. The band delivery apparatus according to claim 1, wherein each of said first and second chambers is constructed as a substantially closed, flat chamber.

3. The band delivery apparatus according to claim 1, wherein at least the first chamber of the band forward store has a channel structure with at least one U-shaped bend.

4. The band delivery apparatus according to claim 1, wherein the band forward and return stores are formed by at least two sandwiched plates and the first and second chambers are separated by a partition located between the plates.

5. The band delivery apparatus according to claim 1, wherein the first and second openings are immediately juxtaposed one another and the locking means is a buffer store separator which is positioned in the vicinity of the first and second openings.

6. The band delivery apparatus according to claim 1, wherein at least the band forward store has a monitoring sensor for determining the amount of stored band material in said first chamber.

7. The band delivery apparatus according to claim 1, wherein the band return store has a monitoring sensor for monitoring the band material in said second chamber.

8. The band delivery apparatus according to claim 1, wherein in the vicinity of the first and second openings is provided a movable auxiliary band channel for guiding the band past said first and second openings when in a closed position.

9. The band delivery apparatus according to claim 1, wherein at least the band forward store contains a delivery means for facilitating the drawing in of the band into said first chamber.

10. The band delivery apparatus according to claim 9, wherein said delivery means comprises a rotated conveyer which forms at least a portion of a side wall of the first chamber of the band forward store.

11. The band delivery apparatus according to claim 1, wherein a movable band supply channel is located upstream from a band stretching device which stretches the band in a direction of said movable band supply channel.

12. A method of delivering a band, comprising the steps of:

(a) providing an apparatus including feed means for forwardly and reversely feeding a band along a band path toward and away from an application location;

a band forward store having a first chamber and a first chamber opening;

a band return store having a second chamber and a second chamber opening;

said first chamber opening and said second chamber opening each being located in a transverse direction off of the band path;

locking means for selectively locking and stopping the band at a location along the band path in between said first and second chamber openings and for selectively allowing the band to pass along the band path;

said locking means enabling a central portion of the band to buckle in a direction transverse to the length of the band into the first chamber through the first chamber opening for prestorage of the band during forward feeding of the feed means and enabling a central portion of the band to buckle in a direction transverse to the length of the band into the second chamber through the second chamber opening for return storage of the band during reverse feeding of the feed means;

the feed means having a first conveyer roller pair located upstream of the forward store;

a moveable auxiliary band channel for guiding the band along the band path past the first and second openings when in a closed position;

a movable band supply channel located upstream from a stretching device which stretches the band in a direction of the movable band supply channel;

a monitoring sensor for determining the amount of stored band material in the first chamber;

(b) introducing a band up to the first conveyer roller pair located upstream of the band forward store;

(c) forwardly feeding the band with the guidance of the band by the auxiliary band channel and the guidance of the band by the band supply channel;

(d) prestoring a predetermined amount of band material in accordance with the monitoring sensor in the band forward store first chamber by locking and stopping the band between the first and second chamber openings with the locking means;

(e) forwardly feeding the band material prestored in the band forward store and/or band return store to the application location;

(f) stretching the band by means of the stretching device;

(g) connecting and cutting the band in the application location;

(h) reverse feeding slack band material into the band return store second chamber by locking and stopping the band between the first and second chamber openings with the locking means; and (i) forwardly feeding and prestoring band material inside the band forward store first chamber.

13. The method according to claim 12, wherein the steps e to i are cyclically repeated.

14. The method according to claim 12, wherein the quantity of band material to be prestored in the band forward store is determined as a function of the band material present in the band return store.

15. The method according to claim 12, wherein the prestoring of the band forward store is brought about by coordinated cooperation of the first conveyor roller pair and said locking means.

16. The method according to claim 12, wherein the filling of the band return store in step h is brought about by the coordinated cooperation of a second conveyor roller pair of the feed means and said locking means.

17. The method according to claim 12, wherein prior to steps d, h or i the auxiliary band channel is moved to an open position which frees the first and second openings.

18. The method according to claim 12, wherein steps d and h of filling of the band stores are each initiated by holding the band by means of said locking means and forming a band loop.

* * * * *